United States Patent [19]

Anderson

[11] Patent Number: 4,624,181

[45] Date of Patent: Nov. 25, 1986

[54] CAN IDENTIFICATION METHOD AND APPARATUS

[76] Inventor: James D. Anderson, 54 Hubbard Ave., San Fernando, Calif. 91340

[21] Appl. No.: 736,105

[22] Filed: May 20, 1985

[51] Int. Cl.[4] ..... B44B 5/02

[52] U.S. Cl. ..... 101/4; 101/30

[58] Field of Search ..... 101/30, 26, 24, 19, 101/4, 41, 44

[56] References Cited

U.S. PATENT DOCUMENTS

| | | | |
|---|---|---|---|
| 1,798,729 | 3/1931 | Divekey | 101/30 |
| 2,201,302 | 5/1940 | Rowe | 101/41 X |
| 2,603,146 | 7/1952 | Lyon | 101/30 |
| 3,304,857 | 2/1967 | Schmidt, III | 101/30 |
| 4,506,999 | 3/1985 | Robertson | 400/127 X |

FOREIGN PATENT DOCUMENTS

| | | | |
|---|---|---|---|
| 2460134 | 7/1975 | Fed. Rep. of Germany | 101/4 |

*Primary Examiner*—Clifford D. Crowder

*Attorney, Agent, or Firm*—William W. Haefliger

[57] ABSTRACT

A method of forming identification markings on a thin walled can, includes the steps:

(a) forming the can bottom wall to have outwardly concave shape, (b) providing a punch and forming discrete projections thereon to be separated from one another, (c) and displacing the punch relatively toward the can concave bottom wall to cause the projections to penetrate the wall to depths less than the wall thickness, thereby to form discrete and separate indentations in the can wall, the identations defining at least one recognizable alphanumeric character, and (d) relatively retracting the punch away from the can bottom wall.

16 Claims, 4 Drawing Figures

CAN IDENTIFICATION METHOD AND APPARATUS

BACKGROUND OF THE INVENTION

This invention relates generally to forming identifying markings on cans, and more particularly to stamping indentations in the ends of thin-walled cans.

Presently, cans are marked by arcuate indicia arranged in a circle, the number of arcs varying to provide differentiation as between runs, enabling identification of problem cans or tooling. Thus, it is necessary to count the number of arcs to determine which run was involved, and the sometimes poor quality of such marking presents a serious identification problem when such counting is necessary. Also, wall cracks can form as a result of linear or arc shaped indentations. There is need for an improved identification system eliminating such problems.

SUMMARY OF THE INVENTION

It is a major object of the invention to provide method and apparatus meeting the above need. Basically, the method of the present invention, for forming identification markings on thin-walled cans, includes the steps:

(a) forming the can bottom wall to have outwardly concave shape, (b) providing a punch and forming discrete projections thereon to be separated from one another, (c) and displacing the punch relatively toward said can concave bottom wall to cause the projections to penetrate the wall to depths less than the wall thickness, thereby to form discrete and separate indentations in the can wall, the indentations defining at least one recognizable alphanumeric character, (d) relatively retracting the punch away from the can bottom wall.

As will appear, the (b) step may be carried out to provide said projections to have conical shapes; and the projections may taper toward tips caused to penetrate less than one-half the can bottom wall thickness. Further, the indentations may be formed in a local region of the can bottom wall, which local region has an opposite side inside the can, and including maintaining said opposite side unsupported during said (c) and (d) steps. Accordingly, less penetration force is required than would be in the case of linear indentations, and more indicia can be formed for the same force.

The punch itself is typically provided to have an end surface facing the can bottom wall, and said projections are provided to project from said end surface to an extent between 0.003 and 0.015 inches, said method carried out to prevent engagement of the punch end surface proximate the projections with the can bottom wall. Typically, there are between 4 and 18 projections clustered in a group to form said indentations that define one alphanumeric character, said cluster occupying an area no larger than about 0.050 square inch.

The process can be employed on other thin-walled objects.

These and other objects and advantages of the invention, as well as the details of an illustrative embodiment, will be more fully understood from the following specification and drawings in which:

DRAWING DESCRIPTION

Figure 3:
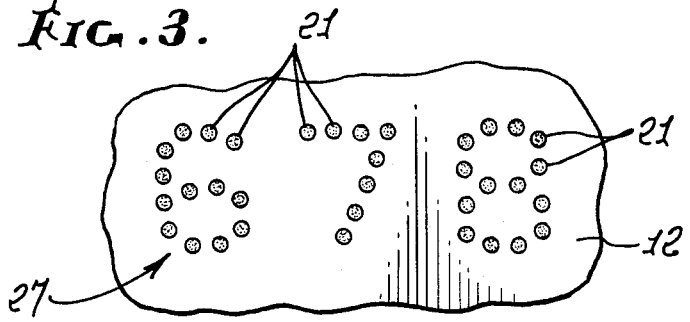
FIG. 3 is a view showing identifying markings in a can end wall.
Figure 3A:
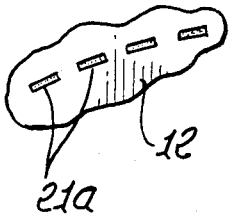

FIG. 3*a* is a view of modified indentations.

DETAILED DESCRIPTION

Figure 1:
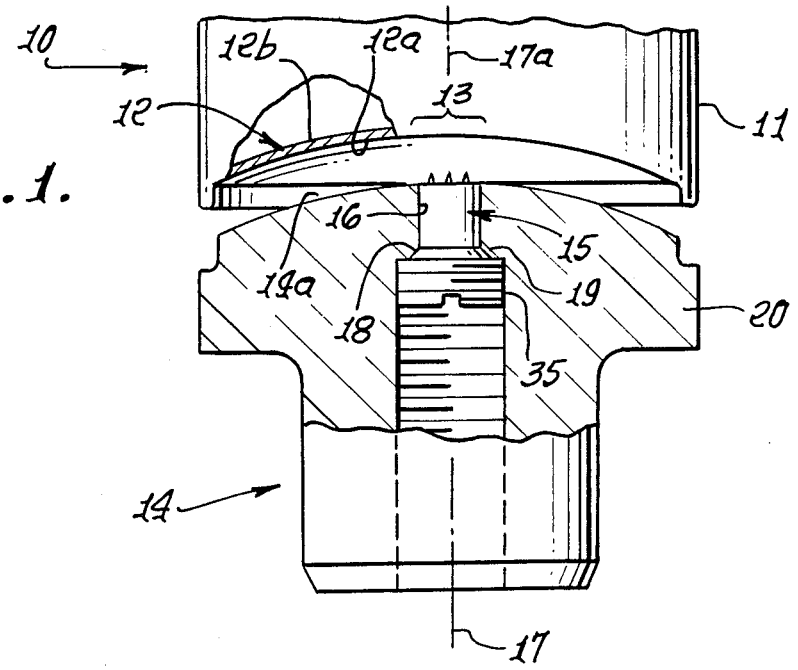
FIG. 1 is a section showing one form of the invention.

In FIG. 1, a thin-walled can 10 has a cylindrical side wall 11 and an end wall 12. The latter is re-entrant to form a reversely domed recess, and the end wall has a concave inner side 12*b*. Side 12*b* is unsupported at the identification marking region 13, during formation of the markings. Tooling such as die 14 has a convex end surface 14*a* adapted to engage wall 12, annularly about region 13, as during the marking process, and it may be regarded as representative of means for forming the can end or bottom wall to have outwardly concave shape.

Tooling 14 includes a punch 15 received and guided in bore 16, movable in the direction of axis 17, aligned with the can axis 17*a*. The punch has an annular stop shoulder 18 which engages limit shoulder 19 of the tool body 20 to located the punch fully displaced forwardly so as to form the indentations 21 in the wall 12. The punch may be thread connected to body 20, as at 35.

Figure 2:
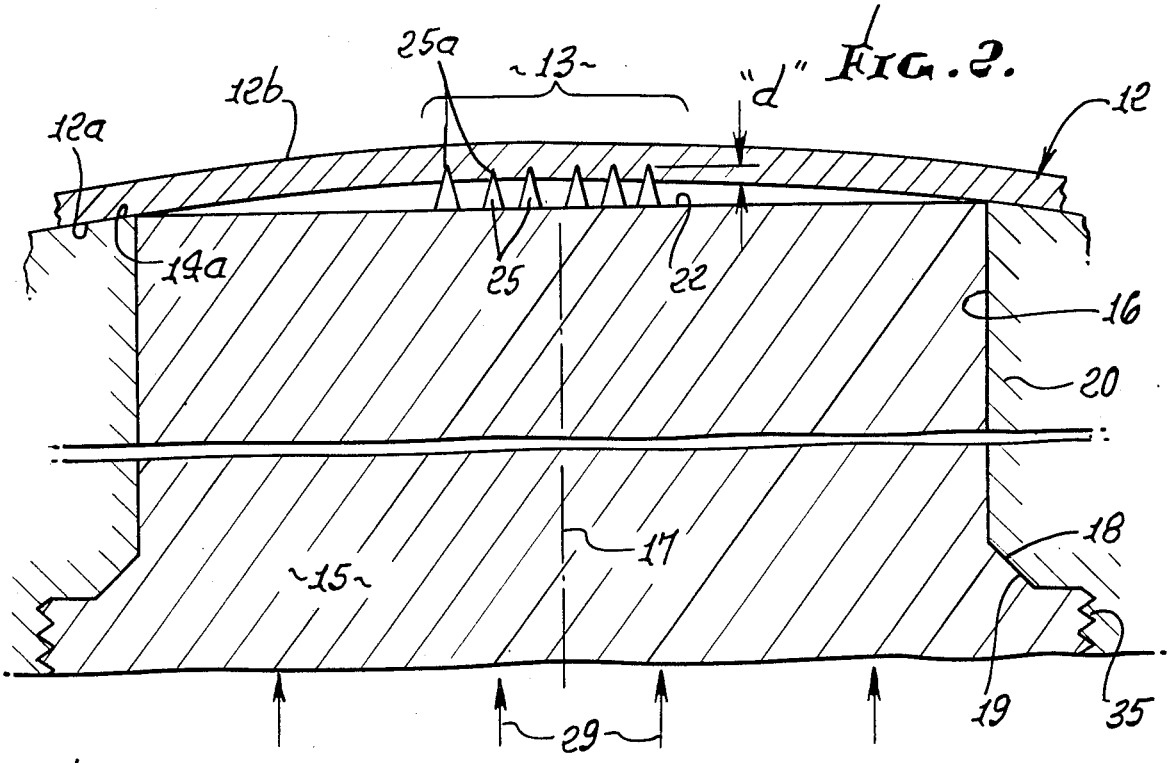
FIG. 2 is an enlarged section, showing penetration of a can end wall to form identifying markings.

Integral with the punch as seen in FIG. 2 is a cluster of projections 25, which project outwardly from surface 22 and toward end wall 12. The projections typically extend normal to surface 22 which is typically convex; therefore the projections are in general not parallel. The projections are tapered to penetrate the wall 12 to depths "d" less than the wall thickness, and preferably less than one-half the wall thickness so as not to weaken it unduly. The thus formed indentations 21, (see also FIG. 3), in cluster 27, define at least one alphanumeric character. Note interengagement of side end wall 14*a* with can end wall surface 12*a* to limit such penetration, the can end wall 12 supported on the die end surface 14*a*, annularly about region 13, at such time.

Arrows 29 indicate force application to the die to effect punch relative movement to cause projection penetration of the wall 12, as described. The punch and die may then be relatively retracted away from the wall 12.

For best results, concomitant with least weakening of the can end wall 12, the projections taper toward tips 25*a*, and they have conical form to produce generally circular outline indentations, as also seen in FIG. 3. This prevents cracks developing in wall 12, proximate the indentations. Also, the indentation cluster is preferably located at the central portion of end wall 12, the latter having a thickness less than about 0.025 inch. The penetration dimension "d" is between 0.003 and 0.015 inches, and preferably about 0.007 and 0.009 inches. Also, there are preferably between 4 and 18 projections clustered to form the indentations that define each alphanumeric character, and 1 to 3 such characters may be formed in region 13. The cluster typically occupies an area no larger than about 0.050 square inch.

Aluminum cans are especially adapted to indicia formation, as described. Other thin-walled bodies (as for example to steel or other metals) are also well adapted to indicia formation, as described.

The separate indentation in wall 12, may be elongated as at 21*a*, in FIG. 3*a*, and formed as described above.

The can bottom wall is typically about 0.010 inches in thickness, and the can side wall about 0.003 inches, in thickness.

I claim:

1. The method of forming identification markings on a thin walled can having a bottom wall with outwardly concave shape, the steps that include (a) providing a punch having a surface facing said wall and discrete projections separated from one another, and projecting from said surface, (b) and displacing the punch relatively toward said can concave bottom wall to cause the projections to penetrate the wall to depths less than the wall thickness, thereby to form discrete and separate indentations in the can wall, the indentations defining at least one recognizable alphanumeric character, said indentations formed in a local region of the can bottom wall, which local region has an opposite side inside the can, and including maintaining said opposite side unsupported during said (a) and (b) steps, and also engaging the punch surface with said wall at locations about said projections, and during said formation of the indentations to control wall deflection and projections penetration into the wall.

2. The method of claim 1 wherein said (a) step is carried out to provide said projections to have conical shape.

3. The method of claim 1 wherein said projections taper toward tips, and wherein said (b) step is carried out to cause said tips to penetrate less than one-half the can bottom wall thickness.

4. The method of claim 1 wherein said local region is confined generally at the central portion of the can bottom wall.

5. The method of claim 1 wherein said can bottom wall has a thickness of less than about 0.025 inch.

6. The method of claim 5 wherein said punch is provided to have an end surface facing the can bottom wall, and said projections are provided to project from said end surface to an extent between 0.003 and 0.015 inches, said method carried out to prevent engagement of the punch end surface proximate the projections with the can bottom wall.

7. The method of claim 1 wherein said indentations are formed to have generally circular outline, and being separated from one another, there being between 4 and 18 indentations clustered to form said character, said indentations clustered to form one alphanumeric character, said cluster occupying an area no larger than about 0.050 square inch.

8. In apparatus for forming indentation markings on a thin-walled can an end wall of which is formed to have outwardly concave shape, the wall free to deflect, the improvement comprising (a) a punch having an end surface and discrete, separated projedtions integral with the punch and projecting outwardly from said end surface and toward the can end wall, the projections tapering toward wall penetrating tips, (b) the punch adapted to be displaced relatively toward said end wall to cause the projections to penetrate the wall to depths less than the wall thickness, thereby to form discrete and separate indentations in the can wall, the indentations defining at least one recognizable alphaa numeric character, (c) said surface being domed about said projections to engage the can end wall during said formation of the indentations, for controlling wall deflection.

9. The improvement of claim 8 wherein said projections are clustered at a local region of said end surface.

10. The improvement of claim 9 wherein said projections are generally conical.

11. The improvement of claim 9 wherein said projections have heights between 0.003 to 0.015 inches.

12. The improvement of claim 9 wherein there are between 4 and 18 projections clustered in a group to form said indentations that define one alphanumeric character, said cluster occupying an area no larger than about 0.050 square inch.

13. The improvement of claim 9 wherein said projections are generally conical.

14. The improvement of claim 8 wherein said projections extend normal to said domed surface.

15. The invention of one of claims 1 and 8 wherein said indentations are elongated, and separated in the direction of their elongation.

16. In apparatus for forming indentation markings on a body wall, free to deflect, the improvement comprising (a) a punch having an end surface and discrete, separated projections integral with the punch and projecting outwardly from said end surface and toward said wall, the projections tapering toward wall penetrating tips, (b) the punch adapted to be displaced relatively toward said end wall to cause the projections to penetrate the wall to depths less than the wall thickness, thereby to form discrete and separate indentations in the wall, the indentations defining at least one recognizable alphanumeric character, (c) said surface being domed about said projections and engaging the wall during said formation of the projections, for controlling wall deflection and the depths of projections penetration into the wall.

* * * * *